US009481994B2

(12) United States Patent
Duforestel et al.

(10) Patent No.: US 9,481,994 B2
(45) Date of Patent: Nov. 1, 2016

(54) THERMAL INSULATION DEVICE

(71) Applicant: ELECTRICITE DE FRANCE, Paris (FR)

(72) Inventors: Thierry Duforestel, Moret sur Loing (FR); Pierre-Henri Milleville, Vernou la Celle (FR)

(73) Assignee: ELECTRICITE DE FRANCE, Paris (FR)

( * ) Notice: Subject to any disclaimer, the term of this patent is extended or adjusted under 35 U.S.C. 154(b) by 0 days.

(21) Appl. No.: 14/407,063

(22) PCT Filed: Jun. 11, 2013

(86) PCT No.: PCT/EP2013/062053
§ 371 (c)(1),
(2) Date: Dec. 10, 2014

(87) PCT Pub. No.: WO2013/186224
PCT Pub. Date: Dec. 19, 2013

(65) Prior Publication Data

US 2015/0176266 A1 Jun. 25, 2015

(30) Foreign Application Priority Data

Jun. 12, 2012 (FR) ..... 12 55495

(51) Int. Cl.
*E04B 1/80* (2006.01)
*E04B 1/76* (2006.01)
*E04B 1/74* (2006.01)

(52) U.S. Cl.
CPC . *E04B 1/76* (2013.01); *E04B 1/74* (2013.01); *E04B 1/80* (2013.01); *E04B 1/803* (2013.01); *E04B 1/806* (2013.01)

(58) Field of Classification Search
CPC ..... E04B 1/80; E04B 1/803; E04B 1/806
See application file for complete search history.

(56) References Cited

U.S. PATENT DOCUMENTS

| | | | | |
|---|---|---|---|---|
| 3,156,975 A | 11/1964 | Shaw | | |
| 5,014,481 A | 5/1991 | Moe | | |
| 5,284,692 A * | 2/1994 | Bell | B32B 7/02 | 29/886 |
| 2013/0101789 A1* | 4/2013 | Lubart | B32B 3/12 | 428/137 |

FOREIGN PATENT DOCUMENTS

| | | |
|---|---|---|
| WO | WO 89/09860 | 10/1989 |
| WO | WO 03/054456 A1 | 7/2003 |

* cited by examiner

*Primary Examiner* — Alexander Thomas
(74) *Attorney, Agent, or Firm* — Blakely Sokoloff Taylor & Zafman LLP

(57) ABSTRACT

The invention relates to a thermal insulation device comprising at least one panel (100) defining a gas-tight chamber (104) containing at least two flexible films (150, 160) suitable for being selectively switched between two states: one of thermal conduction wherein said flexible films (150, 160) are at least partially in mutual contact, and the other of thermal insulation wherein the flexible films (150, 160) are separated, under the influence of pressure variations in said gas-tight chamber (104), applied by fluid control means (170), characterized in that, in the thermal insulation state, the distance separating the flexible films (150, 160) is shorter than the average free path of the gas molecules in the space (158) defined between said flexible films (150, 160). The invention also relates to a method.

11 Claims, 1 Drawing Sheet

THERMAL INSULATION DEVICE

Figure 1:
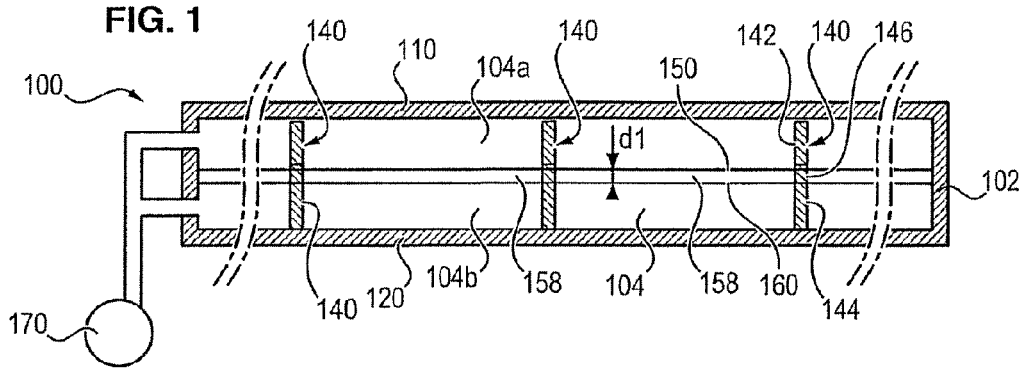

The present invention relates to the field of thermal insulation of buildings.

For many years, but particularly in the last two decades, this field has lead to many research programs, given the issues involved.

In new construction as in renovation, recourse to super-insulating components, that is more insulating than air, actually seems preferred.

Theoretical models predict a minimum of the conductivity thermal of classic insulating materials (solid matrix containing air) of the order of 29 mW/m·K. Forty years of incremental progress since initial manufacture of these materials culminate in this minimum today. To really progress, and especially to leap the threshold of the thermal conductivity of air (25 mW/m·K), the thermal concept has to be changed. Different avenues can be advanced which end in as many concepts on insulation as energy issues and the growing complexity of use.

The following can be cited especially:

nano-structured materials which envisage super insulating functioning at atmospheric pressure, and exploitation of highly insulating properties of a vacuum which, combined with the use of a nano-structured material, defines a concept of insulating panel vacuum.

Known examples of devices of thermal insulation are in documents U.S. Pat. No. 3,968,831, U.S. Pat. No. 3,167,159, DE-A-19647567, U.S. Pat. No. 5,433,056, DE-A-1409994, U.S. Pat. No. 3,920,953, SU-A-2671441, U.S. Pat. No. 5,014,481, U.S. Pat. No. 3,436,3224, DE-A-4300839.

Document U.S. Pat. No. 5,014,481 discloses a device comprising a caisson whereof the internal volume is divided into many layers or air gaps by a series of flexible parallel sheets. The document indicates that the device has a thermal conduction configuration when the sheets are joined and by contrast a thermal insulation configuration when the sheets are separated. This type of device, even though attractive in theory as it is supposed to enable switching between two states exhibiting different thermal insulation properties by controlling of fluidic type, has not however undergone real development. In fact, it exhibits really interesting thermal insulation properties only on condition of having a large number of supple sheets together defining a large number of layers or air gaps. Such a device is however difficult to make, bulky and costly.

Another avenue of investigation for making a device of controlled thermal insulation, that is, designed to modify thermal conductivity on command, is proposed in documents U.S. Pat. No. 3,734,172 and WO-A-03/054456.

Document U.S. Pat. No. 3,734,172, published in 1973, proposes a device comprising a stack of supple sheets whereof the distance is supposed to be modified by electrostatic forces, during application of controlled electric voltages between these sheets, by means of a generator and an associated switch.

In practice, such a device has not undergone consequent industrial development, absent a good outcome.

Document WO-A-03/054456 has tried to improve on the situation by proposing a device comprising a panel defined by two partitions separated by spacers and delimiting a chamber placed at ambient pressure or in depression and which houses a deformable membrane. The membrane is connected occasionally to a first partition at a thermally insulating point. It is also clamped between the spacers and the second partition. When opposite polarity potentials are applied to the membrane and the second partition while potentials of same polarity are applied to the first partition and the membrane, the latter is pressed against the second partition. Inversely, when opposite polarity potentials are applied to the membrane and the first partition while potentials of same polarity are applied to the second partition and to the membrane, the latter is pressed against the first partition. It is understood that the resulting switching of state of the membrane theory modifies on command the thermal conductibility between the two partitions.

Document WO-A-03/054456 itself proposes an evolution of this device, which comprises a V-shaped deflector at the base of the spacers, on the side of the second partition and U-shaped cradles on the first partition.

Such attempts at evolution have not however enabled real industrial development on this device.

The dislike by manufacturers for this product, despite strong existing demand in the field of thermal insulation for buildings, largely comes from the complexity of the product, gleaned from simple visual examination of the latter.

In this context, the aim of the present invention now is to propose a novel thermal insulation device which has qualities greater than the state of the art in terms of cost, industrialisation, efficacy and reliability, especially.

This aim is attained within the scope of the present invention by a thermal insulation device, especially for a building, comprising at least one panel comprising two walls separated by a peripheral main spacer to define a gastight chamber, and at least two supple films arranged in said chamber and adapted to be switched selectively between two states: that of thermal conduction in which said supple films are at least partially in mutual contact and the other of thermal insulation in which the supple films are, under the influence of variations in pressure inside said airtight chamber applied by fluid control means, characterized in that in the state of thermal insulation of the distance separating the supple films is less than the free mean path of gas molecules occupying the volume defined between said supple films.

The present invention also relates to a method for managing thermal insulation by control of the pressure inside an gastight internal chamber of a panel comprising two walls separated by a peripheral main spacer defining the airtight chamber above, and at least two supple films arranged in said chamber and adapted to be switched selectively between two states: that of thermal conduction in which said supple films are at least partially in mutual contact and the other of thermal insulation in which the supple films are separated, under the influence of variations in pressure inside said airtight chamber applied by fluid control means, characterized in that it comprises the steps consisting of switching the pressure in said airtight chamber of the panel between high pressure such that the films are in contact over a substantial part of their surface, to place the device in a state of thermal conduction, and low pressure such that the pressure p in compartments defined between the films imposes a distance between the films less than $$\frac{k}{\sqrt{2}\pi d^2}\frac{T}{p},$$

relation in which k represents the Boltzmann constant, d represents the diameter of gas molecules and T represents absolute temperature, to place the device in a state of thermal insulation, the distance separating the supple films being less than the free mean path of gas molecules occupying the defined volume between said supple films.

As will be seen hereinbelow, the present invention has components of thermal insulation capable of varying their thermal resistance between a virtually zero value and a very high value, typically near or greater than 10 $m^2KW$ for a minimal thickness, for example at least less than 1 cm.

Figure 2:
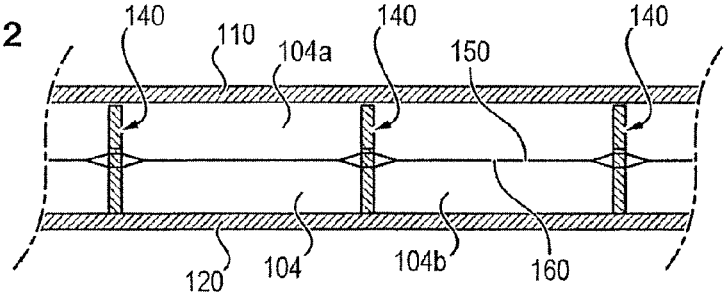
Figure 3:
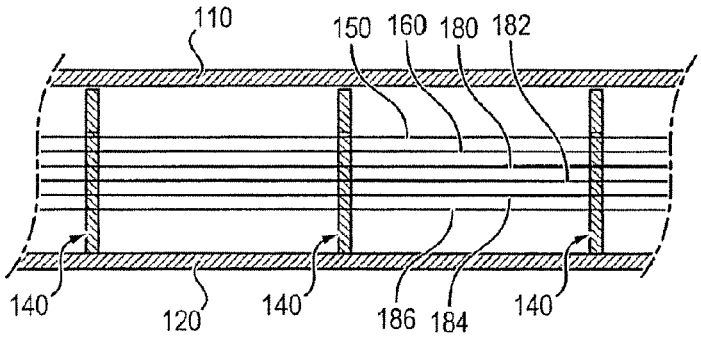
Figure 4:
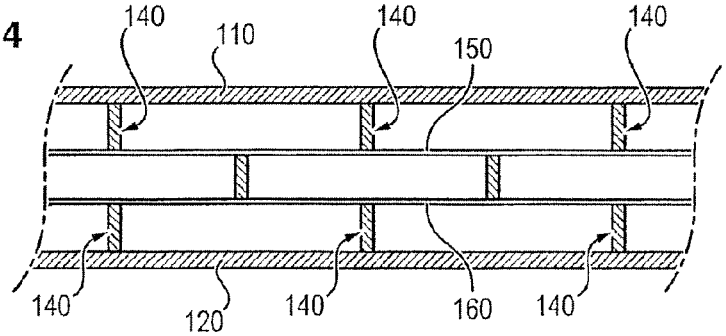

Other characteristics, aims and advantages of the present invention will emerge from the following detailed description, and with respect to the appended drawings, given by way of non-limiting examples and in which:

appended FIGS. 1 and 2 represent, according to schematic views in transversal section, two states of a basic device of thermal insulation according to the present invention, FIG. 3 represents a view of an improved device according to the present invention, and FIG. 4 represents another variant device according to the present invention.

FIG. 1 and the following appended figures show a thermal insulation panel 100 according to the present invention comprising two main walls 110, 120, separated by a peripheral main spacer 102 to form an airtight chamber 104.

The thickness of the spacer 102 and therefore of the chamber 104, viewed perpendicularly to the walls 110 and 120, is very clearly less than the two dimensions orthogonal to it and extending parallel to the walls 110 and 120.

The chamber 104 is placed in depression, that is at a pressure less than the atmospheric pressure or left at atmospheric pressure. Typically, the internal pressure of the chamber 104 is of the order of a few Pascals when said chamber 104 is placed in depression, for example of the order of 10 Pa.

The chamber 104 houses at least two films 150, 160. The films 150, 160, are supple. They extend parallel to the walls 110, 120, preferably substantially at mid-thickness of the chamber 104.

The peripheral rim of the films 150, 160 is fixed, for example clamped, in the mass of the peripheral spacer 102, by means which ensure gas tightness, at this level.

The main walls 110, 120 and/or the films 150, 160 can be optically opaque or optically transparent at least in the visible field (wavelength of 0.4-0.8 μm).

The films 150, 160 are advantageously made of material low in emission in the infrared field. Therefore the films 150, 160 have an emission coefficient (defined as being the ratio between the emission of said films and the emission of a dark body) less than 0.1 and preferably less than 0.04, for wavelengths greater than 0.78 μm.

As will be specified hereinbelow, at rest the two films 150 and 160 are separated and define airtight compartments 158 between them.

The pressure remaining in the compartments 158 defined between the supple films 150, 160 is preferably less than the average pressure prevailing in the chamber 104.

More precisely, and this characteristic of the invention will be specified hereinbelow, in a state of thermal insulation such as shown in FIG. 1, the distance dl separating the supple films 150, 160, is less than the free mean path of gas molecules occupying the volume defined between the supple films 150, 160.

As will be specified hereinbelow, this characteristic uses a device having very high thermal insulation properties without requiring substantial thickness.

With the films 150, 160 being placed at mid-distance from the walls 110, 120, they divide the chamber 104 into two sub-chambers 104*a* and 104*b* located respectively on either side of the compartments 158.

Also, according to the invention, the chamber 104 is connected to pressure control means 170 for selectively switching the device between two states by modification of the pressure inside the chamber 104: a state illustrated in FIG. 1 of thermal insulation in which the supple films 150 and 160 are separated and a state illustrated in FIG. 2 of thermal conduction in which the supple films 150 and 160 are at least partially in mutual contact.

Specifically, switching of the state of thermal insulation illustrated in FIG. 1, in the state of thermal conduction illustrated in FIG. 2, is achieved by increasing the pressure inside the chamber 104, under the effect of means 170.

For this purpose, as evident in FIG. 2, the means 170 preferably communicate with the two sub-chambers 104*a*, 104*b*, comprising the chamber 104 and arranged respectively on either side of the films 150, 160.

The device according to the present invention has properties remarkably greater than those of devices in keeping with the state of the art due to reduction in thermal conduction achieved inside the rarefied gas present between the supple films 150, 160.

In fact, with the distance between the films 150, 160 being less than the free mean path of gas molecules, intermolecular shocks, responsible for transmission of heat in classic conduction, are extremely rare in a device according to the present invention.

Shocks occur essentially only between gas molecules and the films 150, 160.

The films 150, 160 can be kept spaced apart, in a thermal insulation position, by different means.

So the films 150, 160 can be kept spaced apart by an electrostatic charge of films, that is by applying identical potential to the different films, relative to the casing comprising the device, especially relative to the walls 110, 120.

In this case, bring the films 150, 160 closer together to switch them to a close thermal conduction position can also be aided by an electrostatic command by placing the adjacent films at opposite polarities.

A variant electrostatic command consists not of repelling the films by repulsive electrostatic force by charging the films at the same potential, but by pressing the deformable supple films 150, 160 against films or additional support plates by way of attractive electrostatic forces by charging the supple deformable films and the support film associated with opposite potentials.

However, preferably, as is seen in FIG. 1 and following, the supple films 150, 160 are kept spaced apart by spacers 140.

More precisely the spacers 140 preferably comprise end sections 142, 144 which are supported on the internal surfaces of the walls 110, 120 and an inserted median element 146 placed between the supple films 150, 160. The supple films 150, 160 are clamped between the inserted element 146 and one of the end sections 142, 144 of the spacers 140.

The spacers 140 can be isolated (formed by pins) or linear (formed by bands) defining a trellis parallel to the films.

They can be aligned as illustrated in FIGS. 1, 2 and 3 or offset as illustrated in FIG. 4.

The meshing of the spacers 140 is preferably fixed.

In an assembly of offset spacers 140 such as illustrated in FIG. 4, the intermediate element 146 is not aligned with the end sections 142, 144. All the films are mechanically stressed by the pressure forces.

In an assembly of superposed spacers such as illustrated in FIGS. 1 to 3, only the external films are stressed by these forces. In this latter case, the intermediate films, without mechanical function, can be much finer and much closer.

At the theoretical level which is at the basis of the invention, it is recalled that the free mean path Ipm of gas is inversely proportional to the pressure and proportional to the temperature (absolute). The kinetic theory of perfect gases results in the following formula:

$$lpm = \frac{k}{\sqrt{2}\pi d^2}\frac{T}{p}$$

with k the Boltzmann constant (ratio between constant of perfect gases and number (Avogadro), d the diameter of gas molecules (m), T the absolute temperature (K) and p the gas pressure (Pa).

By way of this formula, it can be confirmed that the Ipm of gas at ambient temperature and at atmospheric pressure is of the order of 50 nm and is greater than 0.6 mm for a pressure of the order of 0.12 Pa.

In overlooking the impact of the spacers 140 on the radiative flow, the heat flow ($W/m^2$) is:

$$\phi=(h_r+h_c)\Delta T.$$

In conditions as per the present invention according to which the distance between the supple films 150 and 160 is greater than the free mean path Ipm, the coefficient of heat exchange characterising the transfer between the two faces of the air gap placed between the films 150 and 160 is:

$$H_c = p\sqrt{\frac{R}{8\pi TM}}\frac{\gamma+1}{\gamma-1}F_a$$

with p, the gas pressure, R the constant of perfect gases, M the molar mass of the gas, γ the ratio between specific heat at pressure and at constant volume (7/5 in practice) and $F_a$ the attenuation coefficient of the thermal transfer at the interfaces (which in practice translates the efficacy of exchange between gases and films and is currently 0.67 for the cases of interest).

If a level of pressure is kept to enabling respect of the condition Ipm much greater than the thickness of the air gap (or p=0.12 Pa for an air gap of 0.6 mm), a coefficient of exchange hc of the order of 0.09 $W/m^2K$ is obtained.

By adopting classic equations of radiative exchange between two semi-infinite planes opposite one another, for a low enough difference in temperature between the two films (in practice less than 40° C.) this can produce good approximation of the radiative flow by the following linear expression:

$$\phi_r=4\epsilon_{eq}\sigma T^3_m(T_1-T_2)$$

With $T_1$ and $T_2$ representing the temperature of the two films 150 and 160, $T_m$ representing the average temperature of the two films, σ representing the STEFAN constant equal to $5.67.10^{-8}W\cdot m^{-2}\cdot K^{-4}$ $\epsilon_{eq}$ representing the equivalent emissivity of the two films which is expressed by $\epsilon_{eq}=\epsilon_1\epsilon_2/(\epsilon_1+\epsilon_2-\epsilon_1\epsilon_2)$.

If the option is for low-emission films, for example with emissivity of the order of 4%, the result is a coefficient of exchange by linearised radiation $hr=\phi_r/\Delta T=0.12$ $W/m^2K$.

So for a vacuum of the order of 0.12 Pa in an air gap of 0.6 mm, the result is a coefficient of exchange of total heat $h_r+h_c$ of the order of 0.09 $W/m^2K$+0.12 $W/m^2K$=0.21 $W/m^2K$.

In an even greater vacuum, for example of the order of $10^{-3}$ Pa, the conductive component $h_e$ becomes negligible before the radiative component $h_r$, the result being a coefficient of exchange equal to the sole radiative coefficient by a value of 0.12 $W/m^2K$ with a minimal component thickness.

Of course, the spacers 140 must be adapted, both to their constitutive material, their geometry and their contact with the films,—accurate contact is preferred—, to minimise the resulting thermal bridges.

So the spacers 102 and 140 are preferably made of thermally insulating material so as not to constitute a thermal bridge between the walls 110 and 120. The spacers 102, 140 are formed advantageously from thermoplastic material.

The spacers 140 are spaced by 4 cm and can be either isolated (cross-section of 1 mm×1 mm) or linear (width of 1 mm).

The device according to the present invention constitutes an active insulation component. It can be adapted to the dynamic performance of the building and constitute a pilot for use of inertia of a building due to its faculty for switching between highly insulating static performance on the thermal plane or by comparison highly conductive and therefore capable of transmitting heat flow.

Those skilled in the art will also understand that because of its properties of thermal insulation whereof performance is independent of the thickness, the present invention produces devices of thermal insulation having very high insulation power without needing substantial thickness.

Typically, the present invention forms a device whereof the thermal resistance can switch between for example 0.024 $m^2K/W$ and 80 $m^2K/W$ for a thickness which does not exceed 1 cm.

The operation of the device according to the present invention shown in the appended figures is essentially the following.

When the pressure applied by the means 170 inside the chamber 104 presses the two films 150, 160 against each other at mid-thickness of the chamber 104 as illustrated in FIG. 2, the device is placed in a state of thermal conduction. In fact, the films 150, 160, permit a certain reciprocal thermal transfer.

On the contrary, when the films 150 and 160 are kept spaced apart from each other, as illustrated in FIG. 1, by a distance less than the free mean path of the gas molecules present in the compartments 158, the device is placed in a state of thermal insulation.

The walls 110, 120 comprising the panel 100 can form the object of many variant embodiments.

The walls 110, 120 can be rigid. As a variant, they can be supple. In this case, the panel 100 can be rolled up, making it easier to transport and store.

The walls 110, 120 can be made of metal.

They can also be made of composite material, for example in the form of an electrically insulating layer connected to an electrically conductive layer (metal or material charged with electrically conductive particles).

Similarly, when an electrostatic command is used to control the switching of states of films, the supple films 150, 160 are at least partially electrically conductive to allow application of the electrical field required by the generation of the above electrostatic forces.

Typically, the supple films 150, 160 can be formed from a sheet of supple metal or based on thermoplastic material or equivalent, charged with electrically conductive particles.

The supple films 150, 160, can each be formed from an electrically conductive core coated on each of its faces by a coating of electrically conductive insulating material (thermoplastic material for example).

The device according to the present invention for example retrieves the solar contributions of walls exposed in winter or cools walls in summer when the external freshness allows, by placing the device in its thermally conductive state illustrated in FIG. 2, or on the contrary places them in a thermally insulating state by placing them in the state illustrated in FIG. 1.

As indicated previously, all the components of the device according to the present invention, that is, walls 110, 120 and films 150, 160 can be optically transparent. The device according to the present invention can be applied to transparent walls.

It is noted particular that all the devices in keeping with the prior art using core materials do not allow such a property of optical transparency.

The panels of thermal insulation according to the present invention can also play a decoration role.

If the device according to the present invention is applied to the wasteful walls of a building, insulation can be modulated to optimise the retrieval of external contributions (solar in winter, freshness in summer). Contrary to the current concept of heating or air conditioning, where internal installation regains heat losses or gains through the envelope, this is a system which manages this heat loss or gain to conserve the preferred conditions of inner comfort. Such control can of course be operated automatically from appropriate thermal probes.

The present invention also contributes to totally controlling thermal the inertia of walls of buildings in limits never attained to date.

Of course, the present invention is not limited to the previously mentioned particular application of insulation of buildings. The present invention which results in excellent electrical insulation independent of the thickness of the device and allowing extremely minimal thickness applies the present invention to a large number of technical fields.

The present invention can apply in particular to coatings or any other industrial problem requiring thermal insulation.

Within the scope of the present invention, the above device can be arranged in the form of a modular arrangement of several panels 100 according to the present invention juxtaposed side by side by their edge. Covering elements integrated into the walls 110, 120 of a panel 100 and adapted to overlap the adjacent panel are preferably provided to ensure perfect continuity of insulation. As a variant such covering elements could be provided on elements connected at the level of joining zones between two such adjacent panels 100.

Within the scope of the present invention, a combination of several panels according to the present invention stacked to reinforce thermal insulation can also be provided.

Naturally the present invention is not limited to the particular embodiments which have been described but extends to any variant according to its essence.

A device comprising two parallel supple films 150, 160 inside the chamber 104 has been previously described.

The present invention is not however limited to this number of two films and can comprise a greater number of supple films stacked parallel inside the chamber 104. For example the appended FIG. 3 illustrates a variant embodiment according to which 6 supple films 150, 160, 180, 182, 184 and 186 are provided inside the chamber 104.

Operation of this device remains essentially identical to the above operation.

The pressure applied inside the chamber 104 is switched by the means 170 between two levels: high pressure by which all the above films 150, 160, 180, 182, 184 and 186 are joined and lower pressure such that the distance between each pair of adjacent films is less than the free mean path of gas molecules occupying the volume defined between these pairs of supple films.

The invention claimed is:

1. A device for thermal insulation, comprising at least one panel (100) comprising two walls (110, 120) separated by a peripheral main spacer (102) to define a gastight chamber (104), and at least two supple films (150, 160) arranged in said chamber (104) and adapted to be switched selectively between two states: that of thermal conduction in which said supple films (150, 160) are at least partially in mutual contact and the other of thermal insulation in which the supple films (150, 160) are separated, under the influence of variations in pressure inside said airtight chamber (104) applied by fluid control means (170), characterized in that in the state of thermal insulation the distance separating the supple films (150, 160) is less than the free mean path of gas molecules occupying the volume (158) defined between said supple films (150, 160).

2. The device according to claim 1, characterized in that the supple films (150, 160) are kept spaced apart by spacers (140).

3. The device according to claim 1, characterized in that the spacers (140) comprise end sections (142, 144) which are supported on the internal surfaces of the walls (110, 120) and a median inserted element (146) placed between the supple films (150, 160).

4. The device according to claim 1, characterized in that the distance between the supple films (150, 160) is controlled by electrostatic forces.

5. The device according to claim 1, characterized in that the main walls (110, 120) and the films (150, 160) are optically transparent at least in the visible field.

6. The device according to claim 1, characterized in that the films (150, 160) have an emission coefficient less than 0.1 for wavelengths greater than 0.78 μm.

7. The device according to claim 1, characterized in that each pair of two adjacent films (150, 160) together defines airtight compartments (158).

8. The device according to claim 1, characterized in that when the films (150, 160) are in the separated state, the pressure prevailing in the compartments defined between the films (150, 160) is of the order of 0.12 Pa and the distance separating the films is of the order of 0.6 mm.

9. The device according to claim 1, characterized in that the walls (110, 120) are supple.

10. The device according to claim 1, characterized in that the films (150, 160) have an emission coefficient less than 0.04 for wavelengths greater than 0.78 μm.

11. A method for managing thermal insulation by control of the pressure inside a gastight internal chamber (104) of a panel (100) comprising two walls (110, 120) separated by a peripheral main spacer (102) defining the above airtight chamber, and at least two supple films (150, 160) arranged in said chamber (104) and adapted to be switched selectively between two states: that of thermal conduction in which said supple films (150, 160) are at least partially in mutual contact, and the other of thermal insulation in which the supple films (150, 160) are separated, under the influence of variations in pressure inside said airtight chamber (104) applied by fluid control means (170), characterized in that it comprises steps consisting of switching the pressure in said airtight chamber (104) of the panel (100) between high pressure such that the films (150, 160) are in contact over a substantial part of their surface, to place the device in a state of thermal conduction, and low pressure such that the pressure p in compartments (158) defined between the films (150, 160) imposes a distance between the films (150, 160) less than $$\frac{k}{\sqrt{2}\pi d^2}\frac{T}{p},$$

a relation in which k represents the Boltzmann constant, d represents the diameter of gas molecules and T represents the absolute temperature, to place the device in a state of thermal insulation, the distance separating the supple films (150, 160) being less than the free mean path of gas molecules occupying the volume defined between said supple films.

* * * * *